US011674371B1

(12) United States Patent
Bradley et al.

(10) Patent No.: US 11,674,371 B1
(45) Date of Patent: Jun. 13, 2023

(54) TANDEM SUB FOR SELF-ORIENTING PERFORATING SYSTEM

(71) Applicant: Hunting Titan, Inc., Pampa, TX (US)

(72) Inventors: Ryan Bradley, Pampa, TX (US); Julio Cesar Veliz, Cypress, TX (US)

(73) Assignee: Hunting Titan, Inc., Tampa, TX (US)

( * ) Notice: Subject to any disclaimer, the term of this patent is extended or adjusted under 35 U.S.C. 154(b) by 0 days.

(21) Appl. No.: 17/821,784

(22) Filed: Aug. 23, 2022

Related U.S. Application Data

(63) Continuation of application No. PCT/US2022/073443, filed on Jul. 5, 2022.

(60) Provisional application No. 63/301,950, filed on Jan. 21, 2022.

(51) Int. Cl.

| | |
|---|---|
| ***E21B 43/119*** | (2006.01) |
| ***F42B 3/103*** | (2006.01) |
| ***F42B 3/02*** | (2006.01) |
| ***E21B 43/117*** | (2006.01) |

(52) U.S. Cl.
CPC ..... *E21B 43/119* (2013.01); *E21B 43/117* (2013.01); *F42B 3/02* (2013.01); *F42B 3/103* (2013.01)

(58) Field of Classification Search
CPC .... E21B 43/119; E21B 43/116; E21B 43/117; E21B 43/1185; E21B 29/02; F42B 3/02; F42B 3/103; F42D 1/045; F16C 19/06; F16C 19/30; F16C 2202/32; F16C 2352/00
USPC .... 166/297, 55, 255.2, 55.1; 175/4.53–4.59; 89/1.15
See application file for complete search history.

(56) References Cited

U.S. PATENT DOCUMENTS

| | | | | |
|---|---|---|---|---|
| 4,949,793 | A * | 8/1990 | Rubbo | E21B 33/1291 166/134 |
| 6,595,290 | B2 | 7/2003 | George et al. | |
| 9,115,572 | B1 | 8/2015 | Hardesty et al. | |
| 9,382,784 | B1 * | 7/2016 | Hardesty | E21B 43/119 |
| 9,689,223 | B2 | 6/2017 | Schacherer et al. | |
| 9,903,185 | B2 | 2/2018 | Ursi et al. | |
| 10,689,955 | B1 | 6/2020 | Mauldin et al. | |
| 11,078,762 | B2 | 8/2021 | Mauldin et al. | |
| 2003/0098158 | A1 | 5/2003 | George et al. | |
| 2006/0075889 | A1 * | 4/2006 | Walker | E21B 43/117 102/320 |
| 2006/0102352 | A1 * | 5/2006 | Walker | E21B 43/119 175/4.6 |
| 2006/0108148 | A1 * | 5/2006 | Walker | E21B 43/1185 175/4.6 |
| 2015/0226044 | A1 | 8/2015 | Ursi et al. | |
| 2016/0208587 | A1 | 7/2016 | Hardesty et al. | |
| 2020/0308938 | A1 * | 10/2020 | Sullivan | E21B 43/116 |
| 2021/0222525 | A1 | 7/2021 | Dyess et al. | |

(Continued)

FOREIGN PATENT DOCUMENTS

| | | | |
|---|---|---|---|
| WO | 2021116338 | A1 | 6/2021 |

OTHER PUBLICATIONS

PCT Written Opinion of the International Search Authority, dated Oct. 26, 2022, 12 pages.

*Primary Examiner* — Michael D David

(57) ABSTRACT

A method and apparatus for using a tandem sub to connect one or more perforating gun assemblies, having a rotational bearing mechanism lining the inner diameter in both ends to allow the charge tube assembly to rotate within the gun body.

30 Claims, 8 Drawing Sheets

(56) References Cited

U.S. PATENT DOCUMENTS

2022/0170348 A1* 6/2022 Bryant ..... E21B 43/119

* cited by examiner

TANDEM SUB FOR SELF-ORIENTING PERFORATING SYSTEM

RELATED APPLICATIONS

This application is a bypass continuation of PCT/US22/73443 filed on Jul. 5, 2022, which claims priority to U.S. Provisional Application No. 63/301,950, filed Jan. 21, 2022.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by a detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the ease of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable, because the gun assembler must make wire connections which is prone to human error. The initiating cartridge option is less desirable because the cartridge can be a large explosive device—in comparison to a standard detonator—thus takes up additional magazine space at the user facility.

Conventional perforating in vertical wells or unconventional perforating in horizontal wells conveyed by electrical line during which one or more of the perforating guns in the downhole tool string are oriented by either one or more of the following orientating methods: motorized orientation tool, eccentric weight bars and self-orienting charge tube assemblies.

Oriented perforating is a completion method used to connect to the reservoir formation in a specific transverse plane or to avoid perforating other wellbore tubulars and data lines, such as fiber optic cable, attached to the inside or outside of the casing which is being perforated.

SUMMARY OF EXAMPLE EMBODIMENTS

An example embodiment may include a tandem sub, used to connect one or more perforating gun assemblies, comprising a first rotational bearing mechanism located at a first end, wherein the first rotational bearing mechanism is adapted to engage with a first charge tube in a first perforating gun and allow the first charge tube to rotate freely, a second rotational bearing mechanism located at a second end, wherein the second rotational bearing mechanism is adapted to engage with a second charge tube in a second perforating gun and allow the second charge tube to rotate freely, and an outer tandem housing, wherein the outer housing is adapted to engage a first outer gun housing of the first perforating gun and engage a second outer gun housing of the second perforating gun.

A variation of the example embodiment may include the tandem further comprising of a feed through bulkhead installed within a through passage, wherein the feed through bulkhead provides an electric contact between the first perforating gun and the second perforating gun while further providing a pressure seal between the first perforating gun and the second perforating gun. It may include a first bearing retention nut coupled to the first rotation bearing mechanism, wherein the first bearing retention nut retains and protects the first rotational bearing mechanisms. It may include a second bearing retention nut coupled to the second rotation bearing mechanism, wherein the second bearing retention nut retains and protects the first rotational bearing mechanisms. The first rotation bearing mechanism may be a needle bearing. The second rotation bearing mechanism may be a needle bearing.

An example embodiment may include a perforating gun system comprising a first perforating gun with a first charge tube, a second perforating gun with a second charge tube, a first tandem sub, used to connect one or more perforating gun assemblies, further comprising: a first rotational bearing mechanism located at a first end, wherein the first rotational bearing mechanism is coupled with the first charge tube in the first perforating gun, and a second rotational bearing mechanism located at a second end, wherein the second rotational bearing mechanism is coupled with the second charge tube in the second perforating gun.

A variation of the example embodiment may include a feed through bulkhead installed within a through passage in the first tandem sub, wherein the feed through bulkhead provides an electric contact between the first perforating gun and the second perforating gun while further providing a pressure seal between the first perforating gun and the second perforating gun. It may include a top end fitting coupling a first end of the first charge tube to the first rotational bearing mechanism, wherein the top end fitting is made of non-conductive material. It may include an electrical contact protruding outward from the top end fitting into the feed through bulkhead. It may include a wired connection connecting the top end fitting electrical contact to the input wire of a controller switch contained within the top end fitting. It may include a through wire running the length of the first charge tube connecting an output wire of the controller switch to the electrical contact on a bottom end fitting. It may include a bottom end fitting on a second end of the charge tube. The bottom end fitting is composed of non-conductive material with an electrical contact protruding outward from the center of the bottom end fitting body. The top end fitting of the first charge tube assembly is supported by the first rotational bearing mechanisms in the first tandem sub. It may include the first tandem sub having an outer tandem housing, wherein the outer housing is adapted to engage a first outer gun housing of the first perforating gun and engage a second outer gun housing of the second perforating gun. The first charge tube may be weighted and freely rotates within the first perforating gun. The second charge tube may be weighted and freely rotates within the second perforating gun.

An example embodiment may include a perforating gun system comprising a first perforating gun having a charge tube containing one or more perforating charges and an eccentric weight, a first tandem sub further comprising a first rotational bearing mechanism located at a first end, wherein the first rotational bearing mechanism is coupled to a first end of the first charge cradle counterweight in the first perforating gun, and a second rotational bearing mechanism located at a second end, a second tandem sub further comprising, a first rotational bearing mechanism located at a first end, and a second rotational bearing mechanism located at a second end, wherein the second rotational bearing mechanism is coupled to a second end of the first charge cradle counterweight in the first perforating gun.

A variation of the example embodiment may include a first feed through bulkhead installed within a through passage in the first tandem sub and a second feed through bulkhead installed within a through passage in the second tandem sub. It may include a top end fitting coupling a first end of the first charge cradle counterweight to the first rotational bearing mechanism, wherein the top end fitting is made of non-conductive material. It may include an electrical contact protruding outward from the top end fitting into the feed through bulkhead. It may include a wired connection connecting the top end fitting electrical contact to the input wire of a controller switch contained within the top end fitting. It may include a through wire running the length of the charge cradle counterweight connecting an output wire of the controller switch to the electrical contact on a bottom end fitting. It may include a bottom end fitting on a second end of the charge cradle counterweight. The bottom end fitting is composed of non-conductive material with an electrical contact protruding outward from the center of the bottom end fitting body. The top end fitting of the first charge cradle counterweight is supported by the first rotational bearing mechanisms in the first tandem sub. The bottom end fitting of the first charge cradle counterweight may be supported by the second rotational bearing mechanisms in the second tandem sub. The center contacts in the top end fitting and bottom end fitting of the first charge cradle counterweight may electrically couple the first bulkhead feed through with the second bulkhead feed through. It may include a plurality of shape charges, each contained in a shaped charge holder that snaps into a set of parallel rails that are integral to the charge cradle counterweight.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several figures of the drawing. Briefly.

DETAILED DESCRIPTION OF THE EXAMPLE EMBODIMENTS

Figure 1:
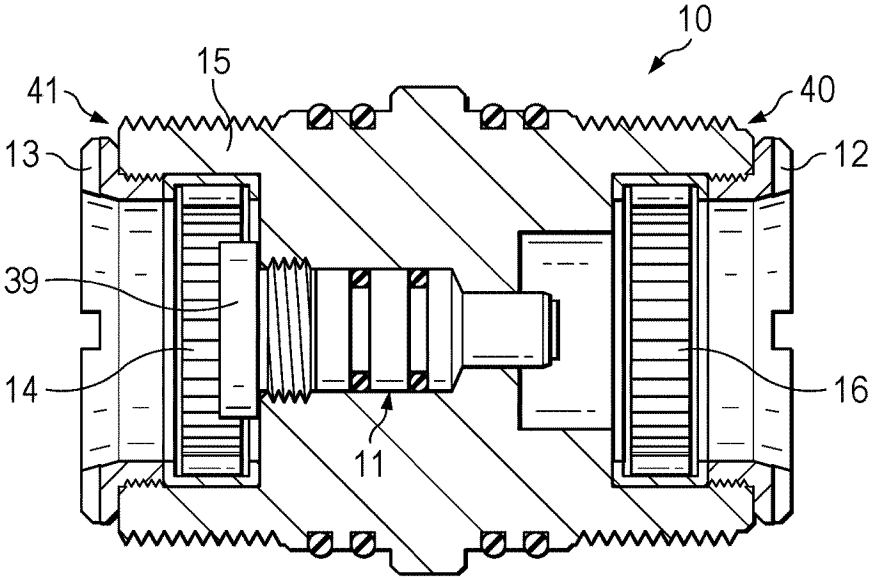
FIG. 1 shows an example embodiment of an orientating tandem sub.

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular initiator assembly disclosed herein.

Traditional methods to orient perforating guns in a horizontal well involve installing eccentric weight bars above, below or above and below the perforating guns so that the entire gun tool string will rotate due to gravity such that the weighted side of the eccentric weight bars are on the low side of the horizontal well. The guns in a traditional oriented perforating string can be locked into a desired shot position, in relation to the weighted side of the eccentric weights, utilizing lock collar tandems between each gun. These traditional orienting methods can be inaccurate (+/−30 degrees) due to well casing conditions and involve adding lengthy eccentric weight bars and lock collar tandems to the string.

There is a need for a simple self-orienting perforating gun system that does not overly increase the cost or length of the perforating tool string. The proposed example embodiments of self-orienting perforating systems may contain tandem subs with a bearing mechanism lining the inner diameter of both ends of said tandem subs such that a self-orienting perforating gun, comprising of a charge tube assembly with counterweighted sections, assembled between two such tandem subs can rotate within the gun carrier due to gravity when the perforating tool string is positioned in a horizontal well. The weighted sections of the charge tube assembly may not increase the length of the perforating gun. The bearing mechanism lining the inner diameter of each end on the tandem sub may be non-disposable and re-usable for cost savings.

Figure 2:
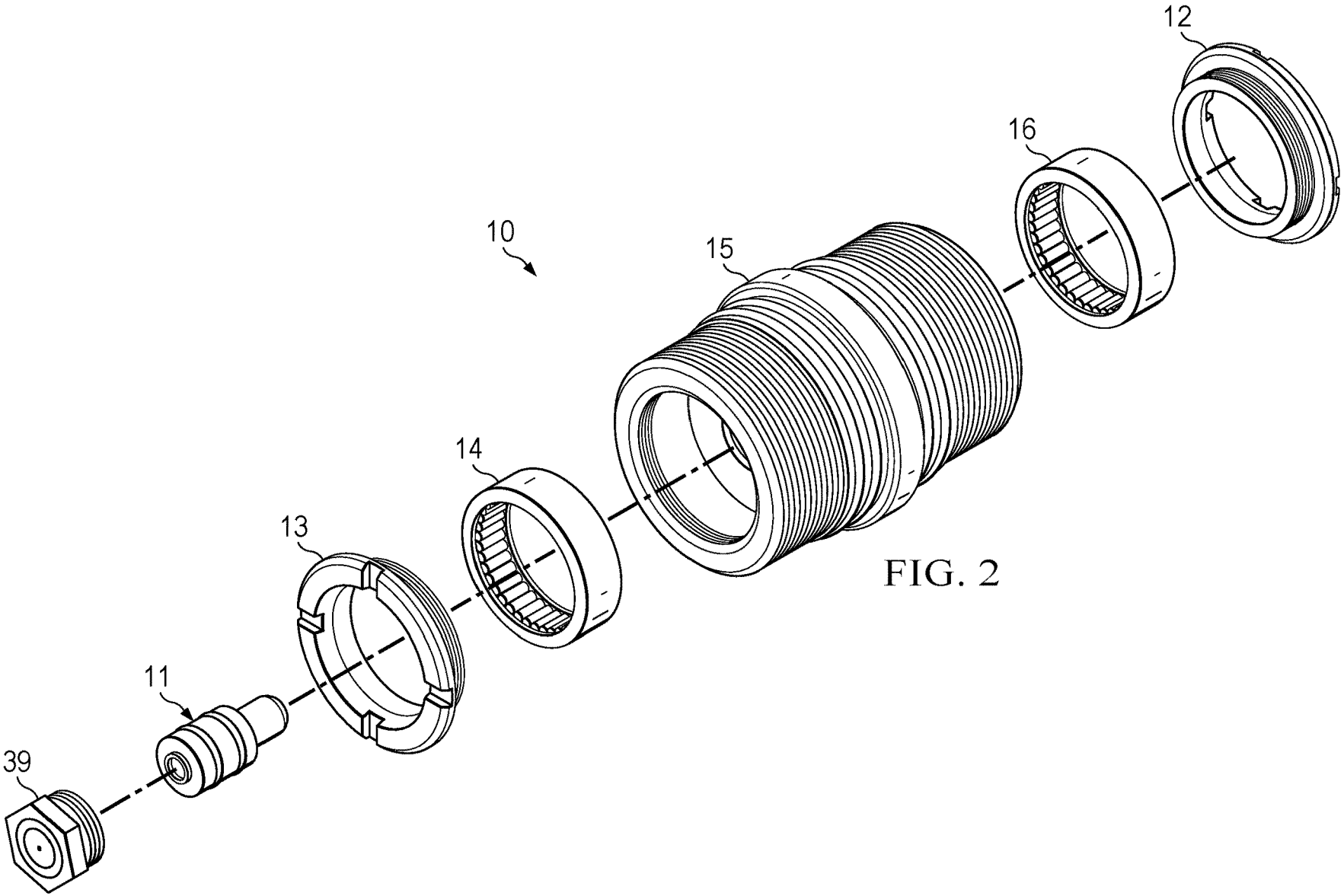
FIG. 2 shows an assembly view of an example embodiment of an orientating tandem sub.

An example embodiment in FIGS. 1 and 2 includes an orienting tandem sub comprising a rotational bearing mechanism lining the inner diameter of both ends such that the charge tube assembly within a perforating gun body assembled between two such tandem subs can rotate within the gun body due to gravity when the perforating tool string is positioned in a horizontal well. The rotational bearing mechanism in the inner diameter of each end of the orienting tandem sub is designed to support each end of the charge tube assembly within the gun body of the self-orienting perforating gun such that the entire charge tube assembly can rotate within the gun body. The self-orienting perforating gun, between the orienting tandem subs, comprises a gun body and a charge tube assembly with counterweighted sections within the gun body. The orienting tandem sub contains threaded connections on both ends to attach a threaded gun assembly so that the gun body and tandem sub cannot rotate in relation to each other once assembled. The orienting tandem sub contains a feed through bulkhead along its center axis that allows electrical continuity from the charge tube assembly of the gun above through the tandem to the next gun charge tube assembly in the gun below as well as provide a pressure seal between the gun below and the gun above. The charge tube assembly of the self-orienting perforating gun has conductive contacts centered on each end to make contact with either end of the feed through bulkhead of the tandem sub when the perforating gun is assembled between two tandem subs. A bearing retention nut is installed on both ends of the orienting tandem between the end of the tandem body and the rotational bearing mechanism. The bearing retention nut protects the rotational bearing mechanism from the perforating gun blast such the rotational bearing mechanism can be re-used.

An example embodiment as shown in FIGS. 1 and 2, may include an orienting tandem sub 10. The orienting tandem sub 10 includes a cylindrical tandem body 15 with outer o-rings to seal and engage with two perforating guns, a first perforating gun can engage with first end 40 and a second perforating gun can engage with second end 41. The tandem body 15 has a through hole adapted to accept a feed through bulkhead 11 held in place by nut 39. The first end 40 includes a first bearing retention nut 12 that includes a first rotational bearing mechanism 16. The second end 41 includes a second bearing retention mechanism 13 that includes a second rotational bearing mechanism 14. The first and second rotational bearing mechanisms 13 and 14 may be a needle roller bearing, a tapered roller bearing, a spherical roller bearing, a cylindrical roller bearing, or a ball bearing design, using a caged roller configuration or a full complement configuration.

Figure 3:
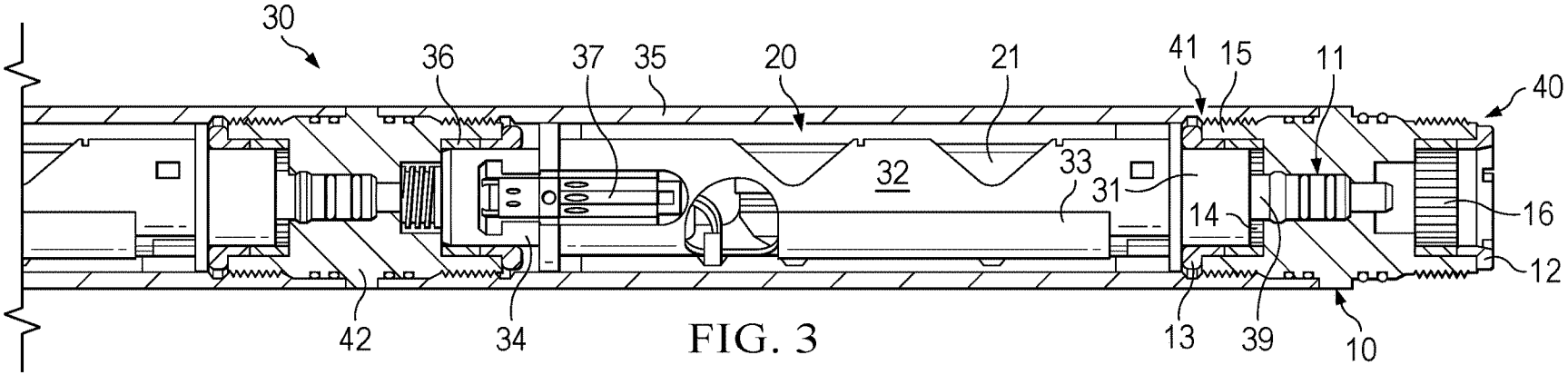
FIG. 3 shows an example embodiment of an orientating tandem sub connecting two perforating guns.
Figure 4:
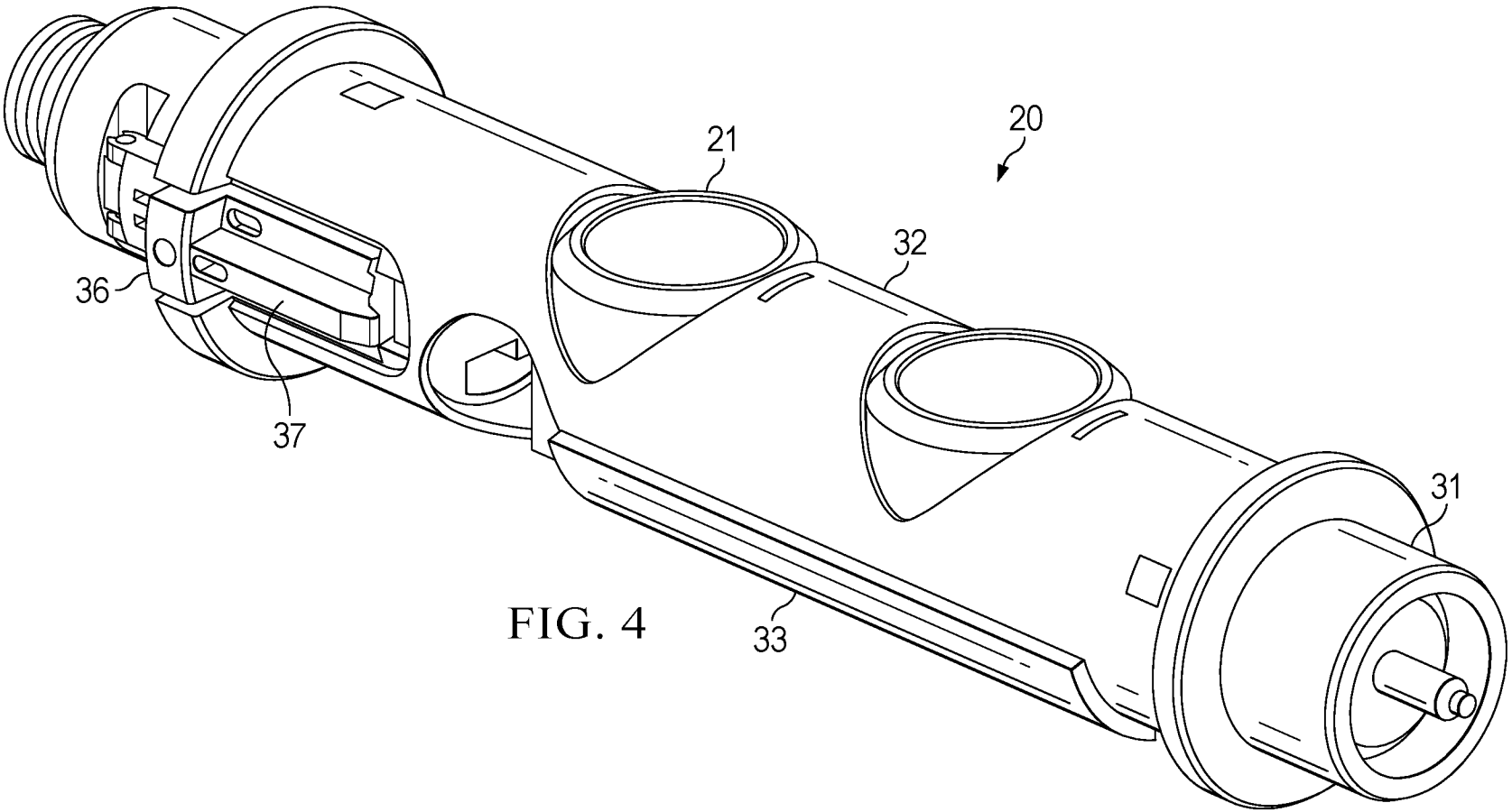
FIG. 4 shows an example embodiment of an orientating tandem sub coupled to the charge tube of a perforating gun.

An example embodiment of a multi-gun assembly 30 is shown in FIG. 3 and FIG. 4. An orienting tandem sub 10 is coupled to a perforating gun 20. The carrier gun housing 35 is coupled to the tandem body 15. The second bearing retention mechanism 13, using the second rotational bearing mechanism 14, is coupled to the charge tube 32 via the bottom end fitting 31. Charge tube 32 includes a counterweight 33. Charge tube 34 includes shaped charges 21. Charge tube 32 is coupled to the rotational bearing mechanism 36 of the second orienting tandem sub 42 via bottom end fitting 34. A detonator assembly 37 is explosively coupled to the shaped charges 21 via a detonating cord. Further, the detonator assembly 37 is shown as being a cartridge design with a door 36 adapted to accept a cartridge style detonator.

Figure 5:
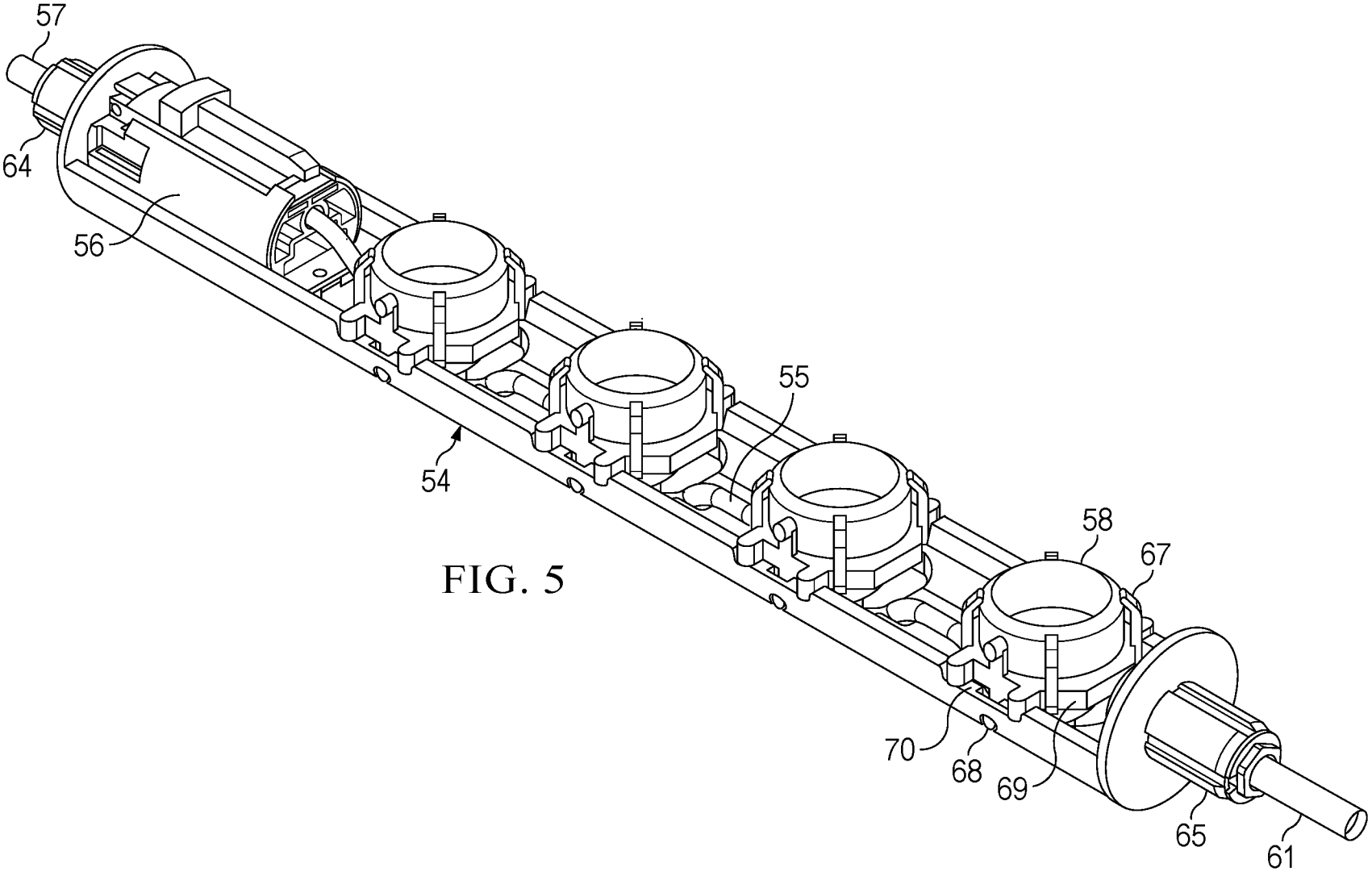
FIG. 5 shows an example embodiment of a gun charge cradle assembly carrier.
Figure 6:
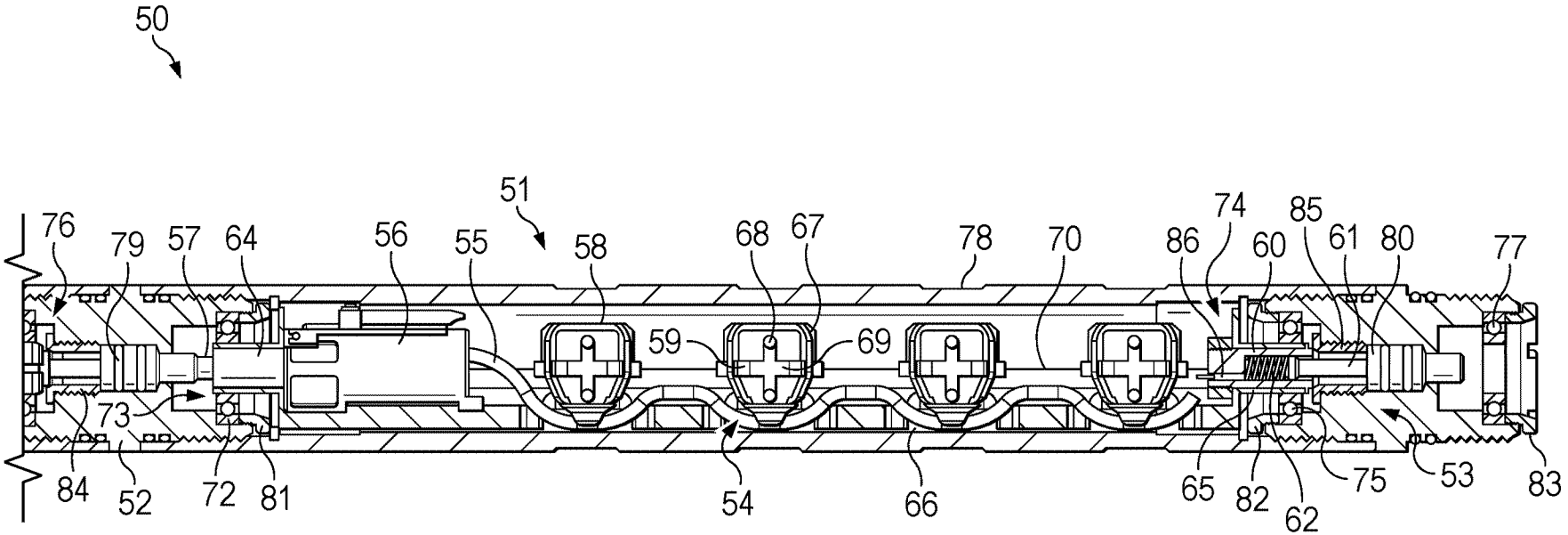
FIG. 6 shows an example embodiment of a gun charge cradle assembly carrier.
Figure 7:
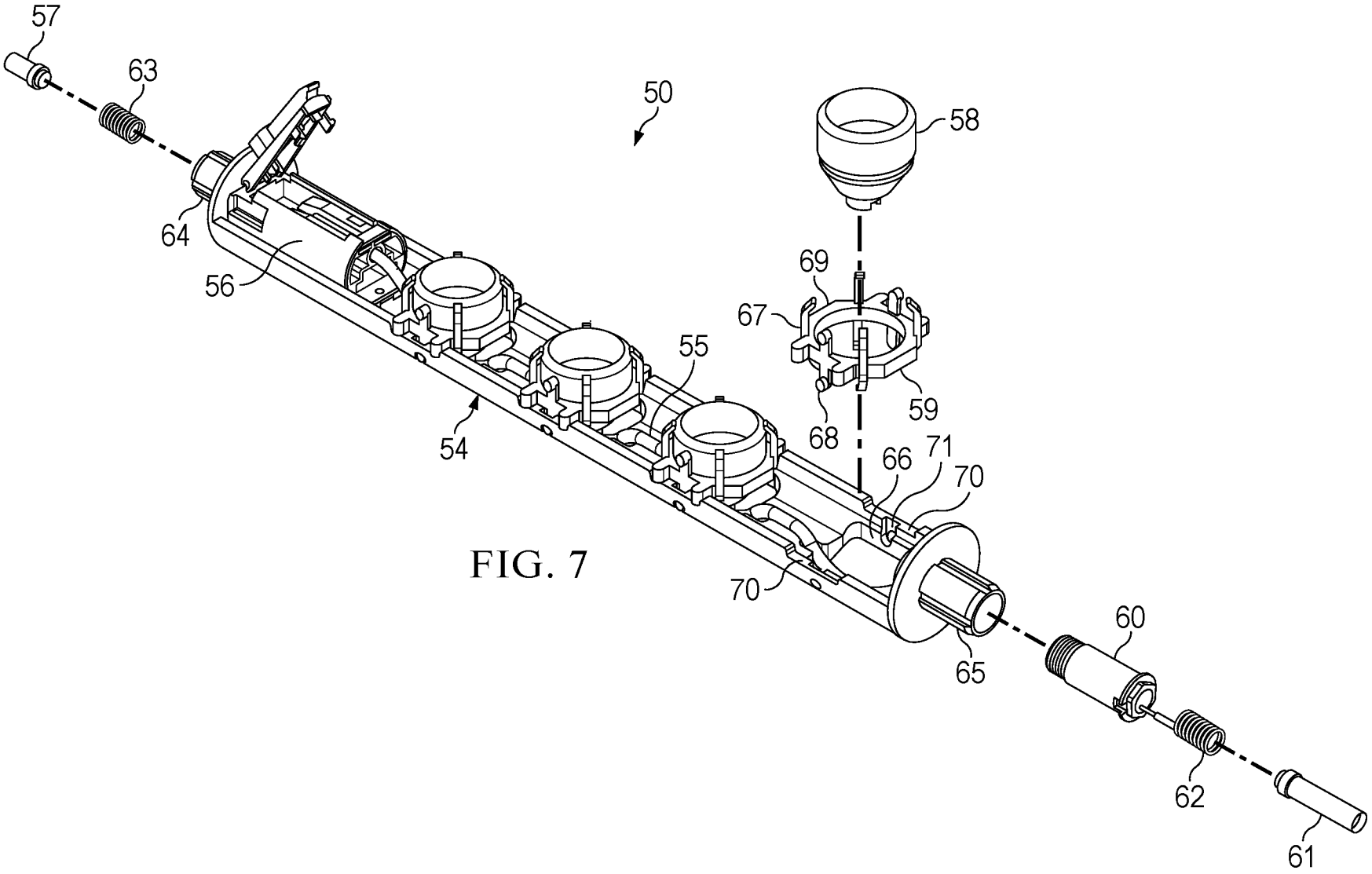
FIG. 7 shows an example embodiment of a gun charge cradle assembly carrier.

An example embodiment is shown in FIG. 5-7 of a gun charge cradle assembly 50. The charge cradle counterweight 54 contains shaped charges 58. Each shaped charge 58 is held in place by a charge retainer 59. The charge retainer 59 includes a retainer body 69 includes a plurality of fingers 67 for holding the shaped charge 58 and clips 68 for clipping into the locking holes 71 of the charge cradle counterweight 54. This secures the retainer body 69 to the cradle rails 70. A detonating cord 55 runs from the top end fitting 56 and is explosively coupled to the back of each shaped charge 58 via a plurality of cutouts 66. The top end fitting 56 may include an integrated control fire switch. The charge cradle counterweight includes bearings 64 and 65. A spring 63 and contact 57 are disposed within the bearing 64. A spring 62 and contact 61 with contact wire 86 are disposed in a contact insulator 60, which is further disposed within the bearing 65.

Referring to FIGS. 5-7, tandem 52 includes a body 76 with a bulkhead 79 held in place by retainer nut 79. Contact subassembly 73 includes bearing 72 held in place by bearing nut 81. Tandem 53 includes a retainer nut 85 holding a bulkhead 80 in place. It includes bearing nut 82 holding the bearing 75 in place. It includes a bearing 77 held in place by bearing nut 83. The gun charge cradle assembly 50 is placed within a gun body 51 which is coupled to the first tandem sub 52 and the second tandem sub 53. The gun body 51 includes scallops 78. The contact subassembly 74 couples to the bearing 75.

Figure 8:
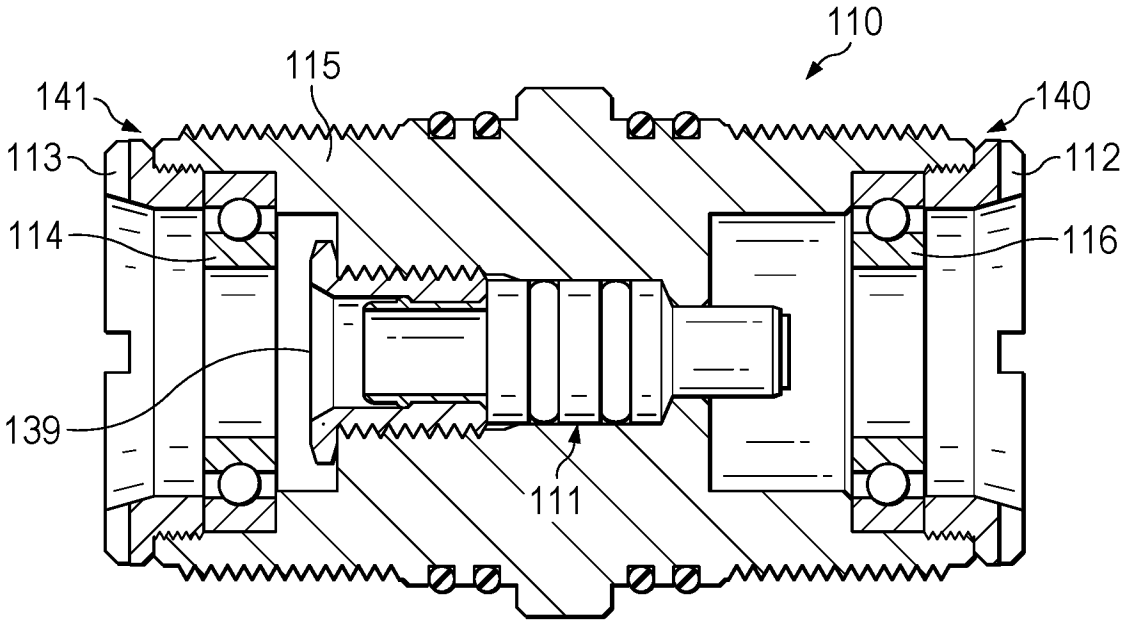
FIG. 8 shows an example embodiment of an orientating tandem sub.
Figure 9:
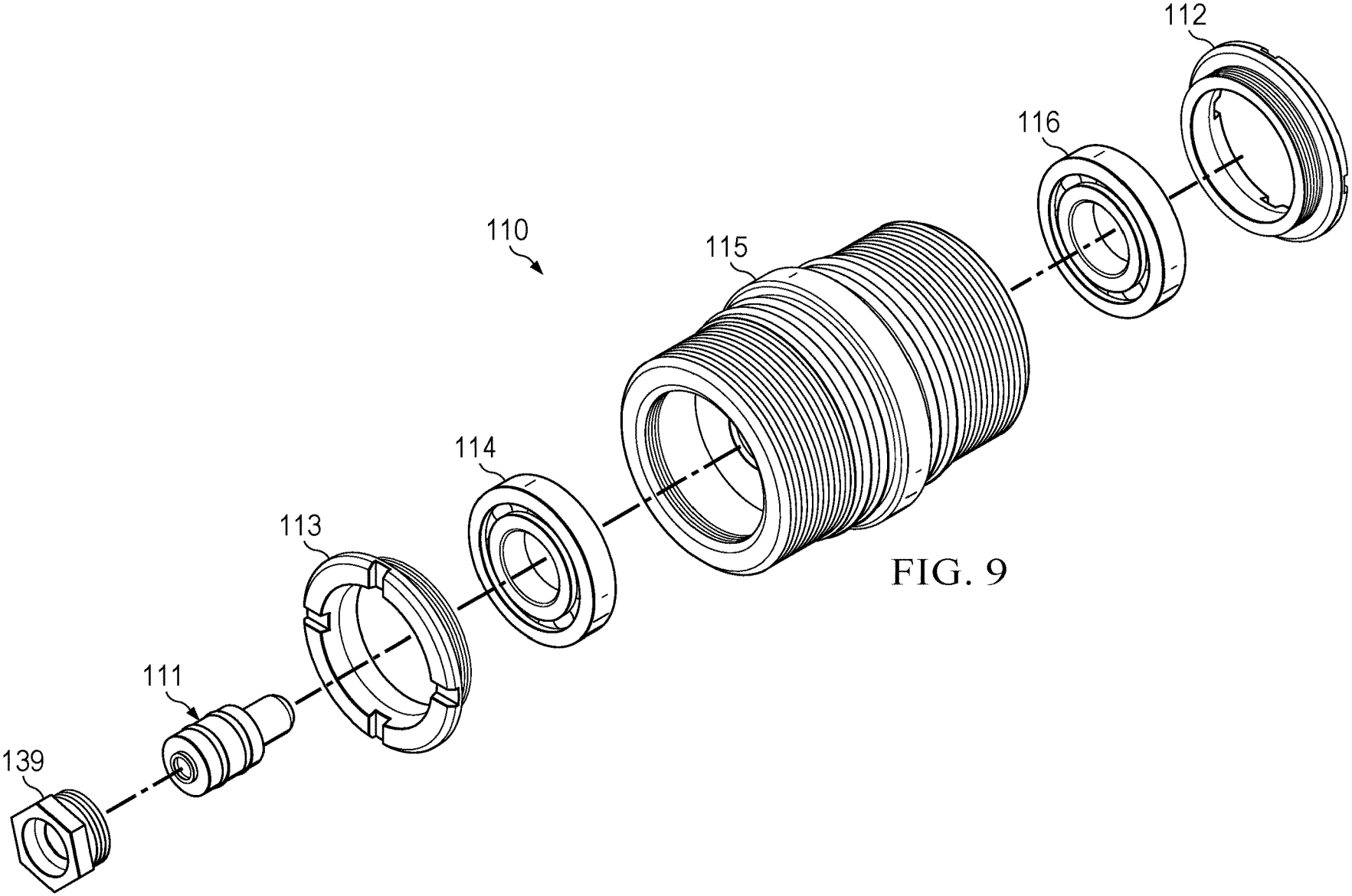
FIG. 9 shows an example embodiment of an orientating tandem sub.

An example embodiment as shown in FIGS. 8 and 9, may include an orienting tandem sub 10. The orienting tandem sub 110 includes a cylindrical tandem body 115 with outer o-rings to seal and engage with two perforating guns, a first perforating gun can engage with first end 140 and a second perforating gun can engage with second end 141. The tandem body 115 has a through hole adapted to accept a feed through bulkhead 111 held in place by nut 139. The first end 140 includes a first bearing retention nut 112 that includes a first rotational bearing mechanism 116. The second end 141 includes a second bearing retention mechanism 113 that includes a second rotational bearing mechanism 114. The first and second rotational bearing mechanisms 113 and 114 may be a needle roller bearing, a tapered roller bearing, a spherical roller bearing, a cylindrical roller bearing, or a ball bearing design, using a caged roller configuration or a full complement configuration.

Although the example embodiments have been described in terms of embodiments which are set forth in detail, it should be understood that this is by illustration only and that the example embodiments are not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the example embodiments are contemplated which may be made without departing from the spirit of the claimed example embodiments.

What is claimed is:

1. A tandem sub, used to connect one or more perforating gun assemblies, comprising:

a first rotational bearing mechanism located at a first end, wherein the first rotational bearing mechanism is adapted to engage with a first charge tube in a first perforating gun and allow the first charge tube to rotate freely;

a second rotational bearing mechanism located at a second end, wherein the second rotational bearing mechanism is adapted to engage with a second charge tube in a second perforating gun and allow the second charge tube to rotate freely; and an outer tandem housing, wherein the outer housing is adapted to engage a first outer gun housing of the first perforating gun and engage a second outer gun housing of the second perforating gun.

2. The tandem sub of claim 1 further comprising a feed through bulkhead installed within a through passage, wherein the feed through bulkhead provides an electric contact between the first perforating gun and the second perforating gun while further providing a pressure seal between the first perforating gun and the second perforating gun.

3. The tandem sub of claim 1 further comprising a first bearing retention nut coupled to the first rotation bearing mechanism, wherein the first bearing retention nut retains and protects the first rotational bearing mechanisms.

4. The tandem sub of claim 1 further comprising a second bearing retention nut coupled to the second rotation bearing mechanism, wherein the second bearing retention nut retains and protects the first rotational bearing mechanisms.

5. The tandem sub of claim 1 wherein the first rotation bearing mechanism is a needle bearing.

6. The tandem sub of claim 1 wherein the second rotation bearing mechanism is a needle bearing.

7. A perforating gun system comprising:

a first perforating gun with a first charge tube;

a second perforating gun with a second charge tube;

a first tandem sub, used to connect one or more perforating gun assemblies, further comprising:

a first rotational bearing mechanism located at a first end, wherein the first rotational bearing mechanism is coupled with the first charge tube in the first perforating gun; and a second rotational bearing mechanism located at a second end, wherein the second rotational bearing mechanism is coupled with the second charge tube in the second perforating gun.

8. The perforating gun system of claim 7 further comprising a feed through bulkhead installed within a through passage in the first tandem sub, wherein the feed through bulkhead provides an electric contact between the first perforating gun and the second perforating gun while further providing a pressure seal between the first perforating gun and the second perforating gun.

9. The perforating gun system of claim 8, further comprising a top end fitting coupling a first end of the first charge tube to the first rotational bearing mechanism, wherein the top end fitting is made of non-conductive material.

10. The perforating gun system of claim 9, further comprising an electrical contact protruding outward from the top end fitting into the feed through bulkhead.

11. The perforating gun system of claim 10, further comprising a wired connection connecting the top end fitting electrical contact to the input wire of a controller switch contained within the top end fitting.

12. The perforating gun system of claim of claim 11, further comprising a through wire running the length of the first charge tube connecting an output wire of the controller switch to the electrical contact on a bottom end fitting.

13. The perforating gun system of claim of claim 9, further comprising a bottom end fitting on a second end of the charge tube.

14. The perforating gun system of claim of claim 13, wherein the bottom end fitting is composed of non-conductive material with an electrical contact protruding outward from the center of the bottom end fitting body.

15. The perforating gun system of claim 9, wherein the top end fitting of the first charge tube assembly is supported by the first rotational bearing mechanisms in the first tandem sub.

16. The perforating gun system of claim 7, further comprising the first tandem sub having an outer tandem housing, wherein the outer housing is adapted to engage a first outer gun housing of the first perforating gun and engage a second outer gun housing of the second perforating gun.

17. The perforating gun system of claim 7, wherein the first charge tube is weighted and freely rotates within the first perforating gun.

18. The perforating gun system of claim 7, wherein the second charge tube is weighted and freely rotates within the second perforating gun.

19. A perforating gun system comprising:

a first perforating gun having a charge tube containing one or more perforating charges and an eccentric weight;

a first tandem sub further comprising:

a first rotational bearing mechanism located at a first end, wherein the first rotational bearing mechanism is coupled to a first end of the first charge cradle counterweight in the first perforating gun; and a second rotational bearing mechanism located at a second end;

a second tandem sub further comprising:

a first rotational bearing mechanism located at a first end; and a second rotational bearing mechanism located at a second end, wherein the second rotational bearing mechanism is coupled to a second end of the first charge cradle counterweight in the first perforating gun.

20. The perforating gun system of claim 19 further comprising a first feed through bulkhead installed within a through passage in the first tandem sub and a second feed through bulkhead installed within a through passage in the second tandem sub.

21. The perforating gun system of claim 20, further comprising a top end fitting coupling a first end of the first charge cradle counterweight to the first rotational bearing mechanism, wherein the top end fitting is made of non-conductive material.

22. The perforating gun system of claim 21, further comprising an electrical contact protruding outward from the top end fitting into the feed through bulkhead.

23. The perforating gun system of claim 22, further comprising a wired connection connecting the top end fitting electrical contact to the input wire of a controller switch contained within the top end fitting.

24. The perforating gun system of claim of claim 23, further comprising a through wire running the length of the charge cradle counterweight connecting an output wire of the controller switch to the electrical contact on a bottom end fitting.

25. The perforating gun system of claim of claim 21, further comprising a bottom end fitting on a second end of the charge cradle counterweight.

26. The perforating gun system of claim of claim 25, wherein the bottom end fitting is composed of non-conductive material with an electrical contact protruding outward from the center of the bottom end fitting body.

27. The perforating gun system of claim 21, wherein the top end fitting of the first charge cradle counterweight is supported by the first rotational bearing mechanisms in the first tandem sub.

28. The perforating gun system of claim 24, wherein the bottom end fitting of the first charge cradle counterweight is supported by the second rotational bearing mechanisms in the second tandem sub.

29. The perforating gun system of claim 26, wherein the center contacts in the top end fitting and bottom end fitting of the first charge cradle counterweight electrically couple the first bulkhead feed through with the second bulkhead feed through.

30. The perforating gun system of claim 19, further comprising a plurality of shape charges, each contained in a shaped charge holder that snaps into a set of parallel rails that are integral to the charge cradle counterweight.

* * * * *